United States Patent [19]

Masaki

[11] Patent Number: 4,701,675

[45] Date of Patent: Oct. 20, 1987

[54] APPARATUS FOR LIMITING ARC DISCHARGE CURRENT IN INCANDESCENT LAMP

[75] Inventor: Kazumi Masaki, Osaka, Japan

[73] Assignee: Ken Hayashibara, Okayama, Japan

[21] Appl. No.: 805,288

[22] Filed: Dec. 5, 1985

[30] Foreign Application Priority Data

Dec. 10, 1984 [JP] Japan ..... 59-259351

[51] Int. Cl.[4] ..... G05F 1/00; H05B 37/02; H05B 39/04; H05B 41/36

[52] U.S. Cl. ..... 315/310; 315/71; 315/74; 338/20; 361/93

[58] Field of Search ..... 315/71, 73, 74, 200, 315/310, 311, 312; 338/20, 21; 361/93

[56] References Cited

U.S. PATENT DOCUMENTS

| | | | |
|---|---|---|---|
| 2,681,429 | 6/1954 | Long | 315/310 X |
| 3,723,852 | 3/1973 | Peterson et al. | 315/311 |
| 3,975,658 | 8/1976 | Emtage | 315/311 |
| 4,005,338 | 1/1977 | Rios | 315/71 |
| 4,271,448 | 2/1981 | Pond | 361/93 |
| 4,572,992 | 2/1986 | Masaki | 315/200 R |
| 4,617,496 | 10/1986 | Samodovitz | 315/311 |

FOREIGN PATENT DOCUMENTS

| | | |
|---|---|---|
| 0071366 | 2/1983 | European Pat. Off. . |
| 0101774 | 3/1984 | European Pat. Off. . |
| 1563261 | 5/1970 | Fed. Rep. of Germany . |
| 1021713 | 3/1966 | United Kingdom . |
| 1589663 | 5/1981 | United Kingdom . |
| 2156611 | 10/1985 | United Kingdom . |

OTHER PUBLICATIONS

"Lamp Saver", Elektor, Sep. 1984, Amsterdam.

*Primary Examiner*—Saxfield Chatmon
*Attorney, Agent, or Firm*—Browdy and Neimark

[57] ABSTRACT

An arc discharge current occurred in dc-illuminated incandescent lamp can be effectively suppressed with an apparatus comprising first resistance connected in series with an incandescent lamp circuit; the second resistance connected in series with the incandescent lamp circuit; and a reverse-blocking triode thyristor connected in parallel with the second resistance and openable with the voltage drop produced between the first resistance by an arc discharge current.

4 Claims, 9 Drawing Figures

APPARATUS FOR LIMITING ARC DISCHARGE CURRENT IN INCANDESCENT LAMP

FIELD OF THE INVENTION

The present invention relates to an apparatus to limit arc discharge current in incandescent lamp.

DESCRIPTION OF THE PRIOR ART

When incandescent lamp is dc-illuminated to reduce flicker, the filament snapping instantly starts arc to flow a relatively high discharge current through the charged gas.

The arc occurs almost in a short-circuit state because the circuit resistance during discharge is extremely low. Upon an actual survey, a discharge current of up to 200 amperes was observed when the filament of 60-watt incandescent lamp was snapped during illumination with dc 130 volts.

The arc discharge current may damage many of the circuit parts.

BRIEF SUMMARY OF THE INVENTION

In view of the foregoing, the main object of the present invention is to provide a means to limit arc discharge current in incandescent lamp.

Still another object of the present invention is to provide a means to automatically effect such current limitation.

These and other objects as may become apparent hereinafter have been attained by an apparatus comprising the first- and second-resistances both connected in series with an incandescent lamp; and a switch member connected in parallel with the second resistance and openable with the voltage drop produced between the first resistance by an arc discharge current that occurs in the incandescent lamp.

DESCRIPTION OF THE PREFERRED EMBODIMENT

Several embodiments according to the invention will hereinafter be explained taken in connection with the accompanying drawings wherein:

FIG. 1 shows the basic circuit of the apparatus according to the invention, particularly the connection instantly upon turning-on;

FIG. 7 shows the current waveform that appears in the circuit as shown in FIG. 5 upon turning-on;

Throughout the accompanying drawings, symbol A designates rectifier; B, time-constant circuit; C, capacitance; D, diode; L, lamp; R, resistance; S, switch; AC, ac power source; and SCR, thyristor.

Figure 1:
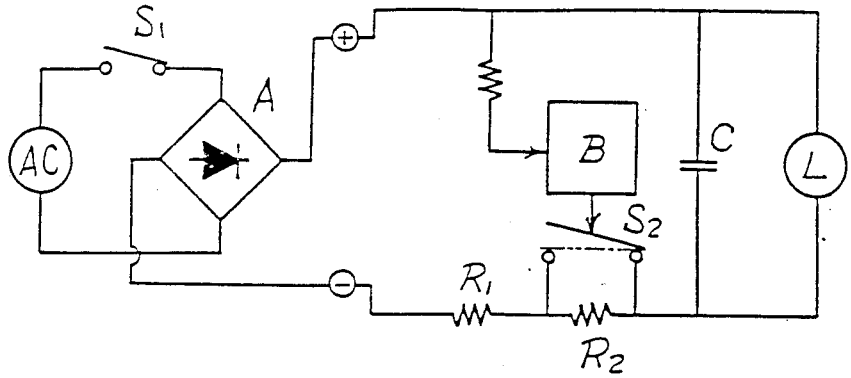
Figure 2:
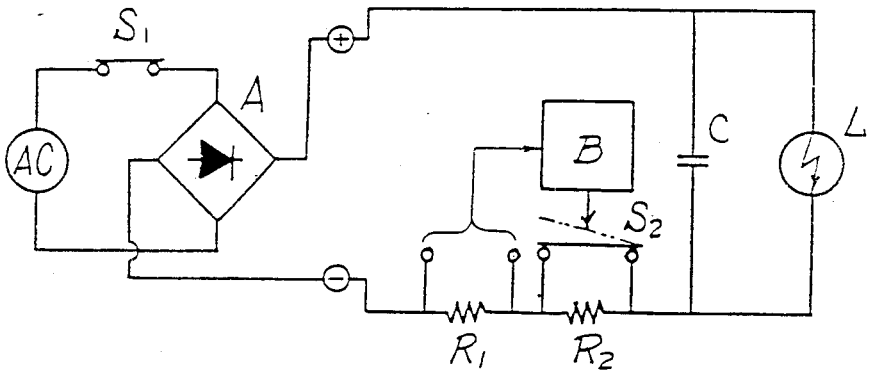
FIG. 2 shows the basic circuit of the apparatus according to the invention, particularly the connection instantly after the filament snapping has generated an arc.

FIGS. 1 and 2 show the basic circuit of the apparatus according to the invention.

The circuit as shown in FIG. 1 is arranged in such a manner that ac current is supplied from ac power source AC to capacitance C and lamp L through power switch $S_1$ and the plus output terminal of full-wave rectifier A. The return circuit is connected to the minus output terminal of full-wave rectifier A through limiting resistance $R_2$.

After a lapse of a prescribed time upon timing-on of power switch $S_1$, time-constant circuit B closes breaking switch $S_2$ to short limiting resistance $R_2$ connected in parallel to switch $S_2$. Thus, the full output of rectifier A is supplied to lamp L.

In the connection as shown in FIG. 2, if the filament of lamp L is snapped when switch $S_2$ is closed, the resultant arc decreases the circuit resistance to approximately zero to flow a discharge current of up to 200 amperes. The discharge current produces a voltage drop across low resistance $R_1$, connected in series to the main current circuit, and the voltage drop operates time-constant circuit B to open breaking switch $S_2$. Thus, the inflow of the discharge current is switched to limiting resistance $R_2$ to suppress the circuit current.

These operation will be further explained with reference to FIGS. 3 and 4.

Figure 3:
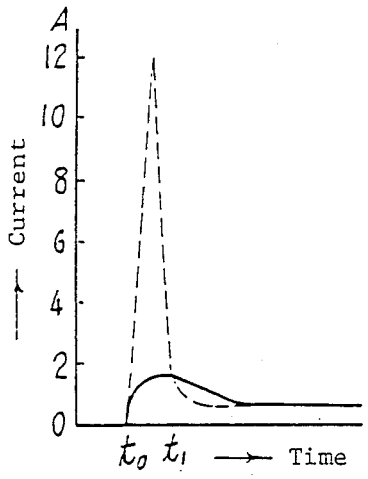
FIG. 3 shows a current curve that appears in the basic circuit as shown in FIG. 1.

Instantly after power switch $S_1$ is closed at time $t_0$, a surge current with a magnitude of 10-fold larger than that of the rating flows as shown in FIG. 3 with the broken line. If limiting resistance $R_2$ is connected in series with lamp L, the circuit current is suppressed as shown in FIG. 3 with the solid line.

Figure 4:
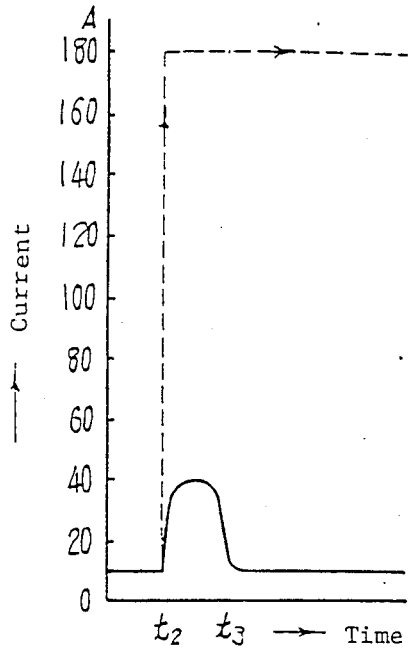
FIG. 4 shows a current curve that appears in the basic circuit as shown in FIG. 2.

FIG. 4 shows the current curve that appears upon filament snapping. The filament snapping instantly starts arc at time $t_2$, and the inflow of a discharge current with a magnitude of 180 amperes continues. If low resistance $R_1$, e.g. 2 ohms, is connected in series to lamp L as particularly shown in FIG. 2, the discharge current is suppressed to 50 amperes or lower. Simultaneously, the voltage drop of about 50 volts, produced across resistance $R_1$ by the discharge current, operates time-constant circuit B to open breaking switch $S_2$. Thus, the circuit current is suppressed as shown in FIG. 4 with the solid line.

Figure 5:
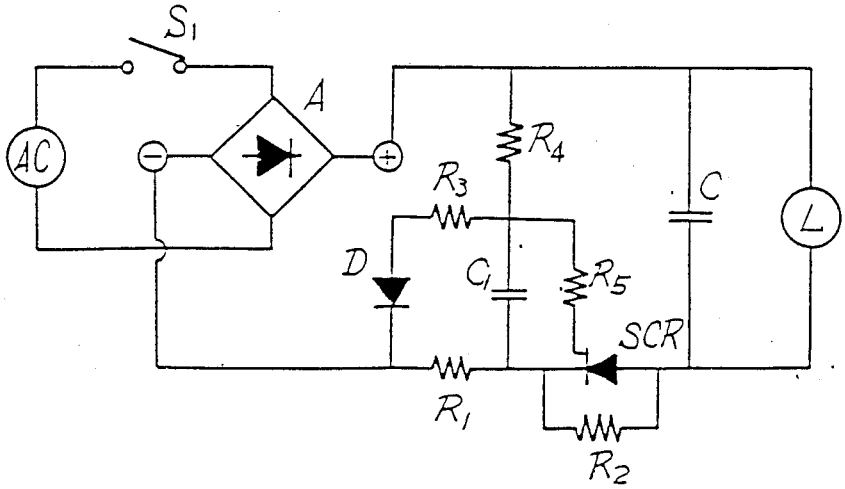
FIG. 5 shows the circuit of an embodiment according to the invention.

FIG. 5 shows the circuit of an embodiment according to the invention. This embodiment is arranged so that turning-on of switch $S_1$ energizes both capacitance C and lamp L. The return circuit is connected to the minus output terminal of rectifier A through both limiting resistance $R_2$ and low resistance $R_1$, placed within lamp L, in order to limit an initial surge current.

The filament resistance of lamp L upon turning-on of power switch $S_1$ is 10 ohms or lower, and the voltage across capacitance C is, therefore, approximately zero. For this reason, the surge current upon turning-on of power switch $S_1$ reaches 20 amperes or higher if limiting resistance $R_2$ and low resistance $R_1$ are not used. The surge current can be suppressed to a level of one ampere or lower by the insertion of limiting resistance $R_2$.

After a lapse of time as determined by timeconstant circuit B consisting of resistance $R_4$ and capacitance $C_1$, capacitance $C_1$ charged through resistance $R_4$ energizes the gate of reverse-blocking triode thyristor SCR to bring it into conduction. The conduction of reverse-blocking triode thyristor SCR shorts limiting resistance $R_2$ to supply the full output of rectifier A to lamp L.

If the filament of lamp L is snapped during illumination, an arc occurs and permits a discharge current of up to 200 amperes to flow through the charged gas. Although in ac-illumination the arc occurs similarly but disappears within one cycle, in dc illumination an arc discharge current continues, to damage the relating circuit parts.

In the circuit according to the invention, a relatively high discharge current produces a voltage drop of up to 100 volts across resistance $R_1$.

The voltage drop negatively charges capacitance $C_1$ through diode D to cancel the positive voltage from resistance $R_4$ and also to decrease the gate voltage of reverse-blocking triode thyristor SCR below its gate-triggering level. Thus, the conduction of the thyristor is suspended, and the increasing voltage drop between limiting resistance $R_2$ stops the arc occurred in lamp L.

Figure 6:
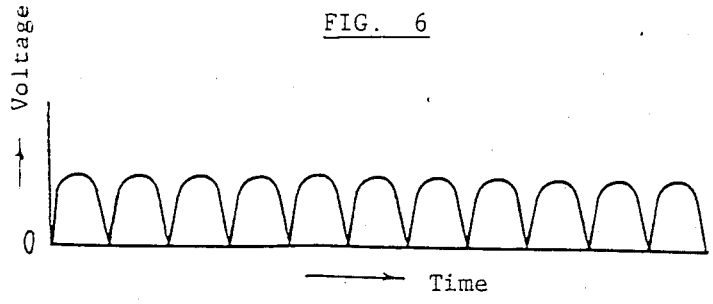
FIG. 6 shows the voltage waveform that appears in the circuit as shown in FIG. 5.
Figure 7:
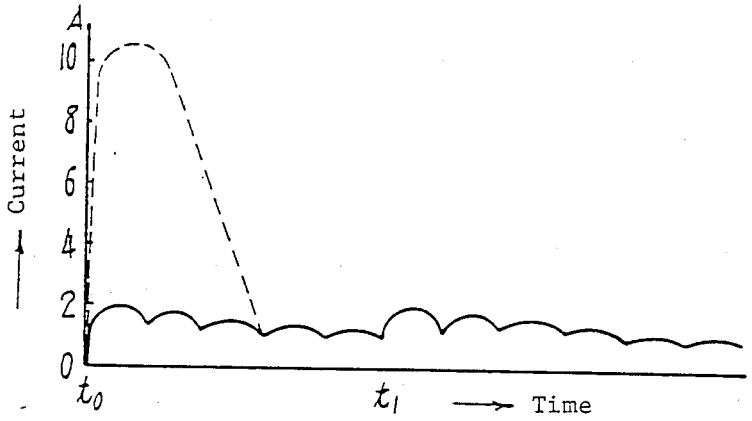

The current- and voltage-waveforms at this moment are as shown in FIGS. 6 and 7.

FIG. 6 shows the voltage curve that appears between the plus-and minus-terminals of rectifier A. As is evident from FIG. 6, reverse-blocking triode thyristor SCR requires a continuous triggering because the voltage curve zero-crossover occurs every half-cycle.

If limiting resistance $R_2$ and low resistance $R_1$ are removed from the circuit as shown in FIG. 5, a surge current of 10 amperes or higher flows upon turning-on of power switch $S_2$ at time $t_0$ as shown in FIG. 7 with the broken line. In the circuit as shown in FIG. 5, the circuit current is suppressed by reverse-blocking triode thyristor SCR and limiting resistance $R_2$ as shown in FIG. 5 with the solid line, and, after a lapse of a prescribed time $t_1$, e.g. 10-odd hundredths of one second, limiting resistance $R_2$ is shorted by reverse-blocking triode thyristor SCR. Thus, the current across the filament of lamp L slightly increases at first, but shortly reaches the stationary level as shown in FIG. 7 with the solid line.

Figure 8:
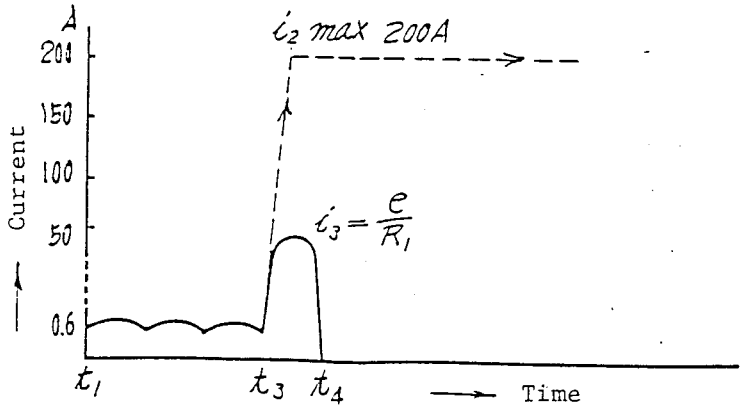
FIG. 8 shows the current waveform that appears in the circuit as shown in FIG. 5 during arc discharge.

As shown in FIG. 8 with the broken line, when lamp L is dc-illuminated in conventional manner, the filament snapping of lamp L produces an arc at time $t_3$, and an discharge current of up to 200 amperes comes into flow. The solid line as shown in FIG. 8 indicates that the discharge current can be suppressed to 50 amperes by setting low resistance $R_1$ in the circuit as shown in FIG. 5 to 2 ohms. The voltage drop produced between low resistance $R_1$ by the discharge current negatively energizes the gate of reverse-blocking triode thyristor SCR to suspend its conduction in the next half-cycle of the waveform chart as shown in FIG. 6.

Figure 9:
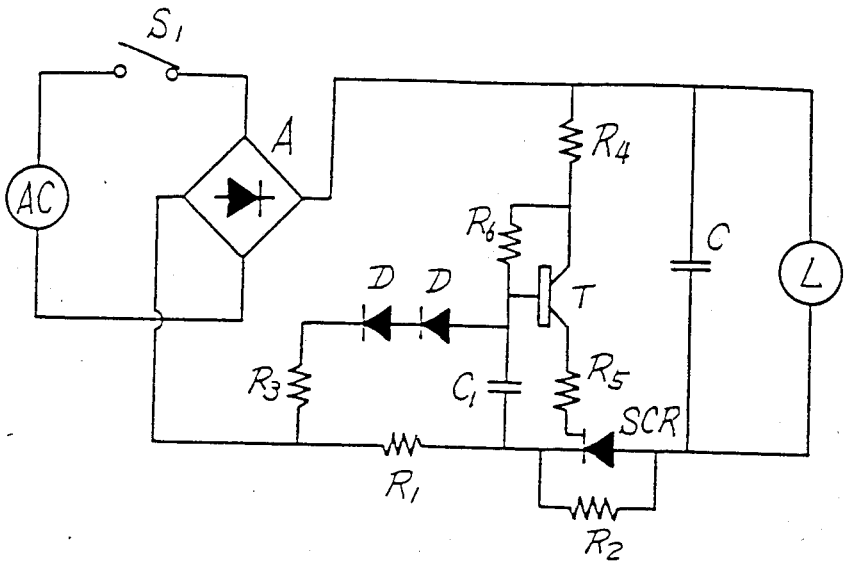
FIG. 9 shows the circuit of an embodiment according to the invention, wherein a transistor is equipped to the limiting circuit.

FIG. 9 shows the circuit of another embodiment according to the invention. This circuit is arranged by replacing a part of the circuit as shown in FIG. 5 with transistor T so that the voltage drop produced across low resistance $R_1$ keeps the base voltage at cut-off level. Thus, the operation of reverse-blocking triode thyristor SCR is suspended with the discharge current for a prescribed time.

Upon turning-on of power switch $S_1$, transistor T is conducted by resistance $R_4$ and $R_6$ to charge capacitance C, and the discharge current from capacitance C conducts reverse-blocking triode thyristor SCR. The voltage drop produced between low resistance $R_1$ negatively charges capacitance C through diode D to keep transistor T at cut-off state for a prescribed time so that no triggering voltage is supplied to reverse-blocking triode thyristor SCR. Thus, the discharge current which occurred in lamp L is broken.

While I have shown and described particular embodiments of my invention, it will be obvious to those skilled in the art that various changes and modifications may be made without departing from my invention in its broader aspects and I, therefore, intend in the appended claims to cover all such changes and modifications as fall within the true spirit and scope of my invention.

I claim:

1. A device to limit arc discharges arising in a dc-operated incandescent lamp, comprising a rectifier circuit having input terminals connected with an ac source, and output terminals connected with said incandescent lamp, first resistance means connected in series with the incandescent lamp, for limiting both an initial switch-on surge into the incandescent lamp and an arc discharge current due to the filament of the incandescent lamp being snapped, second resistive means connected in series with the incandescent lamp, for providing by virtue of a voltage drop across it a signal indicating occurrence of arc discharge current, switching means having a trigger electrode and a main current path, said main current path being connected in parallel with the first resistive means, and a time constant circuit, having an output connected with the trigger electrode of the switching means, to retard, on switch-on, the conduction of the switching means in accordance with its time constant, and to suspend the conduction of the switching means when the voltage across the second resistive means reaches a predetermined level.

2. The device of claim 1, wherein said switching means comprises a reverse-blocking triode thyristor.

3. The device of claim 1, wherein the first and second resistive means are resistors.

4. The device of claim 1 comprising a capacitor connected in parallel with said incandescent lamp.

* * * * *